United States Patent [19]

Butler

[11] 4,406,109

[45] Sep. 27, 1983

[54] AUTOMATIC CORD HANKING MACHINE

[75] Inventor: John D. Butler, New Berlin, Wis.

[73] Assignee: Artos Engineering Company, New Berlin, Wis.

[21] Appl. No.: 297,830

[22] Filed: Aug. 31, 1981

[51] Int. Cl.[3] ..... B65B 63/04

[52] U.S. Cl. ..... 53/116; 53/118; 53/119; 53/532; 242/53

[58] Field of Search ..... 53/118, 116, 119, 582; 242/53

[56] References Cited

U.S. PATENT DOCUMENTS

| | | | |
|---|---|---|---|
| 3,480,219 | 11/1969 | Hanscom | 242/53 |
| 3,480,220 | 11/1969 | Hanscom | 242/53 |
| 4,183,383 | 1/1980 | Gudmestad et al. | 140/105 |

*Primary Examiner*—Nicholas P. Godici
*Assistant Examiner*—Kurt Rowan
*Attorney, Agent, or Firm*—James E. Nilles

[57] ABSTRACT

The hanking machine of this invention cooperates with a lead forming machine wherein each cord, gripped near opposite ends by intermittently moving cord grippers, arrives at a discharge station where the cord, extending along a horizontal line, is released by the grippers. Two carriages are guided for motion wherein a cord clamp on each tracks said line. In initial positions of the carriages, towards which they are biased and in which their cord clamps close on a cord substantially simultaneously with its release by the grippers, they are spaced substantial distances to opposite sides of a vertical plane; in release positions, wherein they release the cord, they are substantially nearer said plane. A turntable with coiling posts spaced to opposite sides of its rotational axis, has its axis horizontal and contained in said plane and has its coiling posts projecting across said line, one above it, one below it. Hence, upon rotation, the turntable coils the cord from its center while the cord ends are guided by the carriages that are clamped to them. The carriages reach release positions and detach from the cords substantially simultaneously with conclusion of turntable rotation, whereupon the carriages return under bias to their initial positions.

11 Claims, 25 Drawing Figures

START
a
1/4 TURN
b
1/2 TURN
c
3/4 TURN
d
1 TURN
e

AUTOMATIC CORD HANKING MACHINE

FIELD OF THE INVENTION

This invention relates to an automatic hanking machine whereby wire leads are coiled and tied to be formed into uniform hanks immediately after they have been processed by an automatic lead forming machine that cuts each lead to length, bares the end portions of its conductors, and attaches terminal connectors to at least certain of the bared conductor ends; and the invention is more particularly concerned with an automatic hanking machine which so cooperates with an automatic lead forming machine that a lead processed by the lead forming machine is presented to the hanking machine as a last step in the operation of the lead forming machine.

RELATED PATENT APPLICATION

An automatic cord hanking machine having some features in common with the automatic hanking machine of the present invention is covered by the copending U.S. patent application of Ragnar Gudmestad and John D. Butler, Ser. No. 277,964, filed June 26, 1981, now U.S. Pat. No. 4,375,186 which has a common assignee herewith.

BACKGROUND OF THE INVENTION

The hanking machine of the present invention is intended for cooperation with a wire lead forming machine of the general type disclosed by the copending application of John D. Butler, Ser. No. 235,443, now U.S. Pat. No. 4,370,786 filed Feb. 20, 1981 and by U.S. Pat. No. 4,183,383, both of which have a common assignee herewith. Such a lead forming machine comprises a pair of intermittently moving endless chains with horizontal and parallel top stretches, each chain having cord grippers attached to it at reguarly spaced intervals. At one end of the machine there is mechanism whereby uniform-length cords or leads are cut from a coiled supply of conductor stock of indefinite length. Each such cord is gripped near its opposite ends by a pair of cord grippers, one on each chain, to be held horizontally extended by them and moved transversely to its length past a numer of stations. At some or all of such stations the lead forming machine has mechanisms that operate upon one or both end portions of the cord to prepare it for connection to an electrical appliance. In general, the lead forming machine strips the insulation off of the end portions of the wires that comprise the cord and attaches terminal connectors to at least certain of its end portions, or it otherwise prepares the bared end portions for connection, as by twisting and tinning them. If the leads being made by the machine are intended to serve as power connection cords, the machine will usually cause a wall socket plug to be attached to one end of each cord.

In the past, the leads made by a lead forming machine were simply discharged at its outlet end and where allowed to accumulate until they were carried elsewhere. Where the leads are to be installed as power cords, it is usually desirable that each such cord be coiled and tied into a hank before it is connected to the appliance for which it is intended, and therefore the customary prior practice has been to collect accumulations of finished cords at the lead forming machine and take them to a hanking machine to be coiled and tied. Such batchwise handling of the cords was obviously somewhat inefficient, but heretofore it was regarded as unavoidable because no fully automatic hanking machine has been available.

A commercially available semi-automatic hanking machine that has been rather widely used is disclosed in U.S. Pat. Nos. 3,480,219 and 3,480,220, both issued to H. F. Hanscom. The machine of those patents comprises a turntable that is rotatable on a vertical axis and has a pair of upright coiling posts spaced to opposite sides of its axis. An operator manually inserts one end portion of a lead or cord into a clip on the turntable and depresses a foot switch to start the turntable rotating, thus causing the cord to be wound around the coiling posts. After a pre-determined number of turns the turntable stops, whereupon an arm on another part of the machine moves down and removes the coiled cord from the posts. The arm has claws that engage the coil at spaced apart locations between the posts and close around it. The arm first moves straight up to lift the coil off of the coiling posts, and then it swings laterally to carry the coil to a tying machine by which a wire tie is looped around the middle of the coil and twisted upon itself. The claws thereafter open to release the tied hank into a receptacle or onto a conveyor. Once the coil has been lifted away from the coiling posts, the operator can attach a new cord to the turntable and start a new winding cycle, so that winding of one cord can take place while a previously wound coil is being tied and released from the arm.

It is apparent that the machine of the Hanscom patent can achieve high production with a diligent and patient operator. However, it is also apparent that feeding cords or leads to such a machine demands a certain amount of concentration and coordination on the part of the operator but is a very monotonous task and is therefore very fatiguing.

A problem encountered with any hanking machine is that during the coiling operation there is always a certain amount of cord that extends away from the turntable and is being wound in towards it. If that unwound portion of the cord is not guidingly confined, it can begin to swing around with the turntable instead of being wound into a coil. Such swinging can result in a defective hank with an excessively long pigtail, and it may also endanger nearby personnel. With a manually fed hanking machine the operator provides the necessary guidance for the uncoiled portion of the cord; but with a fully automatic machine, that part of the cord, while being confined against swinging, must nevertheless be free to move lengthwise towrds the turntable at whatever rate is imposed by the coiling operation.

The above-mentioned copending application of Gudmestad, et. al., Ser. No. 277,964, discloses a fully automatic hanking machine whereby a wire lead or other cord that has been discharged from a lead forming machine or the like is gripped near one of its ends, and while that grip is maintained the cord is horizontally extended and is presented to the coiling turntable with its gripped end in a known relationship to the turntable coiling posts. Grippers on the outer ends of the coiling posts close upon the cord near its gripped end, which is then released. The other end of the cord is slidably guided as it is being wound in towards the turntable. The mechanism for presenting cords to the coiling turntable is somewhat complicated, and further complications are involved in the grippers on the coiling posts FIG. 23 is a detail view in elevation of one of the turntables in its condition at the start of the hanking cycle and in relationship to the actuators which effect convergence of its coil holding claws; and FIG. 24 is a detail plan view of one of the turntables in its tying position, together with the tying machine which is shown in its advanced or operative position with its hank removing claw extended.

DETAILED DESCRIPTION OF PREFERRED EMBODIMENT OF THE INVENTION

General Arrangement of the Apparatus

Figures 1, 2, 3A, 3B:
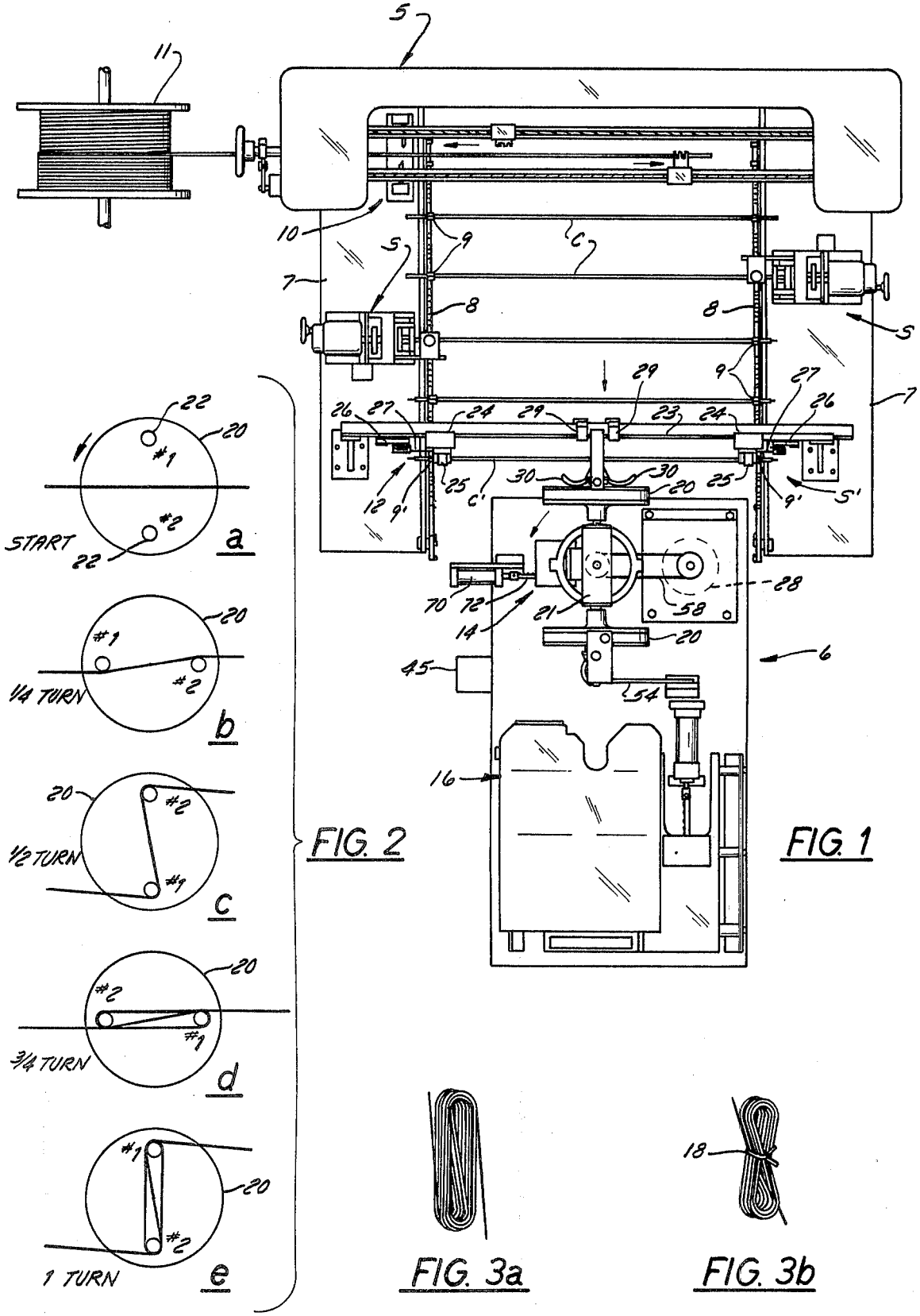

A lead forming machine 5 with which a hanking machine 6 of this invention cooperates is of a generally known type, comprising a pair of elongated frame members 7 that are lengthwise parallel to one another. One each of the frame members there is an intermittently moving endless chain 8 that has a horizontal, lengthwise extending top stretch. Cord grippers 9 are fastened to each chain 8 at intervals along its length, and the cord grippers on the respective chains are arranged to be laterally opposite one another as they move along the top stretches, so that a cord C can be gripped near each of its opposite ends by a pair of cord grippers, one on the top stretch of each chain 8. As held by the grippers 9 the cord C is horizontally extended and bridges across the top stretches of the chains. By reason of the intermittent unison movements of the chains 8, the cord grippers 9 carry clamped cords C to each of a succession of stations S, at each of which the cord dwells for a time while an operation is performed on one or both of its end portions by known automatically operating mechanisms.

The lead forming machine 5 can be regarded as having an infeed end and a discharge end. At its infeed end there is generally conventional mechanism 10 whereby conductor material comprising two or more wires is drawn off of a supply coil 11 of indefinite length and is cut through to form a cord C of predetermined length. The infeed mechanism is located at a first one of the stations S at which the cord grippers 9 pause in their intermittent motion. At that station the cord grippers close upon the length of conductor that has been drawn off of the supply 11. They carry the cord transversely to its length through the several further stations S and ultimately to a discharge station S' near the discharge end of the machine, where they deliver the cord to the hanking machine 6 of this invention and then release their grips upon the cord.

In order for the lead forming machine 5 to be capable of producing leads or cords of any selected length, one of the frame members 7 is laterally adjustable toward and from the other. The hanking machine 6 is located between the discharge end portions of the two frame members 7; and, since the hanking machine should be substantially centered between the frame members, it is preferably so mounted as to be laterally shiftable upon adjustment of the distance between the frame members 7.

Figure 8:
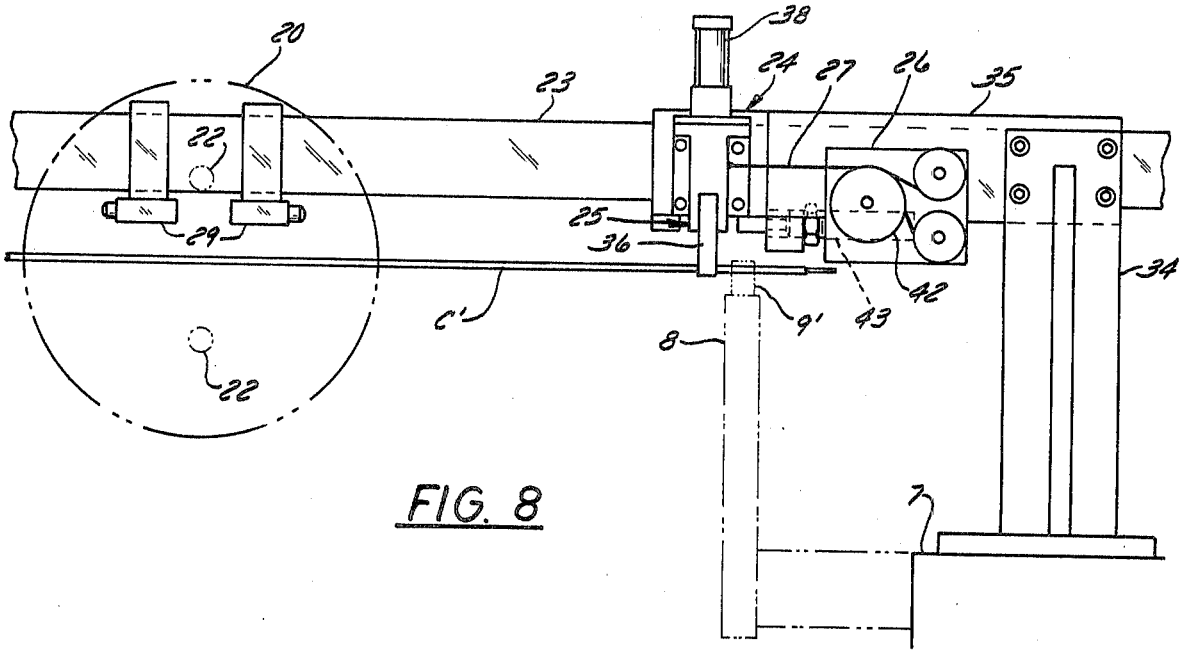

In general, the hanking machine 6 comprises three main subassembles, namely a feed mechanism 12 that receives leads or cords from the cord grippers 9 of the lead forming machine, a coiling mechanism 14 to which cords are presented by the feed mechanism 12 and by which each cord is wound into a coil, and a typing machine 16 by which a wire tie is looped around a coiled cord and is twisted upon itself to hold the cord tied into a hank. FIG. 8*a* shows the appearance of a cord as coiled by the coiling mechanism 14, and FIG. 3*b* shows the appearance of the finished hank with a wire tie 18 looped around the middle of the coiled cord and twisted upon itself. The tying machine 16 is spaced from the feed mechanism 12 by a substantial distance in the direction that cords move through the lead forming machine 5, and the coiling mechanism 14 is between the feed mechanism 12 and the tying machine 16.

The coiling mechanism 14 comprises two essentially identical turntables 20 that are mounted in coaxial, spaced apart relation to one another upon a yoke-like turntable carrier 21. Each turntable 20 has a pair of coiling posts 22 that project from it in the direction away from the other turntable, said posts 22 being parallel to the turntable axis and spaced to opposite sides thereof. As explained hereinafter, the posts 22 of each turntable 20 are normally in coiling positions at equal but adjustable distances from the rotational axis of the turntable, but from its coiling position each post 22 is bodily movable relative to its turntable, against yielding bias, through a limited distance towards the turntable axis.

The turntable carrier 21 swings through 180° in each direction about an axis that transversely intersects the coinciding rotational axes of the turntables 20 and lies between the turntables. Such rotation or swinging of the turntable carrier 21 carries each turntable alternately to a coiling position in which the turntable is near the feeding device 12 and to a tying position in which the turntable is near the tying machine 16. The axis about which the turntable carrier 21 swings is preferably vertical, as illustrated, although it could be horizontal and transverse to the top stretches of the chains 8. When one of the turntables is in its coiling position, the other is of course in its tying position; and when the turntables are in those positions, their coinciding rotational axes are contained in an imaginary fixed vertical plane that is parallel to the upper stretches of the chains 8 and midway between them. That plane also preferably contains the pivot axis of the turntable carrier 21.

Figure 9:
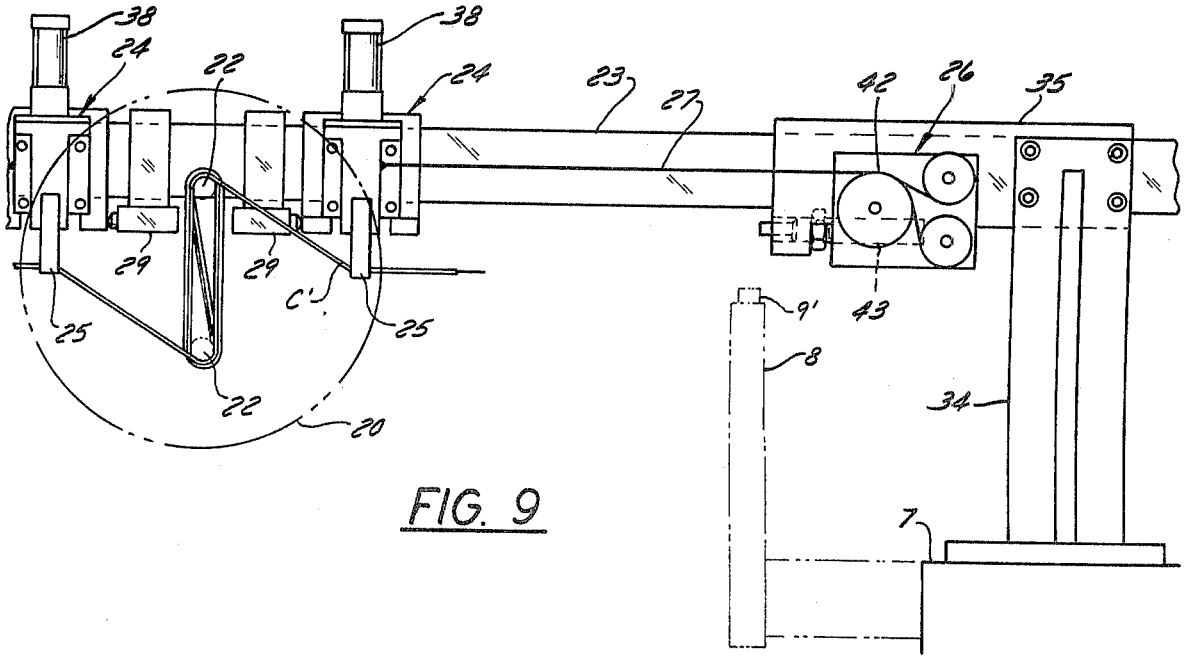

The feed mechanism 12 (FIGS. 4–9) comprises a rail 23 that bridges between the frame members 7 of the lead forming machine, extending normal to the above-mentioned vertical plane, together with a pair of carriages 24, each of which comprises a cord clamp 25 that can be actuated to a closed cord-gripping condition and to an open cord-releasing condition. The carriages 24 are always spaced to opposite sides of said fixed vertical plane, but the rail 23 guides each of the carriages for sliding motion between an initial position, spaced a substantial distance from said plane and shown in FIGS. 1, 4, 5 and 8, and a releasing position, nearer said plane and shown in FIG. 9. For each carriage 24 there is a biasing device 26, mounted on the rail 23 and connected with the carriage by a cable 27, whereby the carriage is yieldingly urged to its initial position.

The rail 23 is so located that as each carriage 24 slides along it, the cord clamp 25 of the carriage tracks along the line defined by a cord C' held by cord grippers 9' (FIGS. 1 and 5) that are at the discharge station S' of the lead forming machine. Thus, when the carriages 24 are in their initial positions, in which each is inwardly adjacent to one of the cord grippers 9', the cord clamp 25 of each carriage, which is open when the carriage arrives at that position, is so located that it can close upon the cord C'. As a cord C' is brought to the discharge station by the cord grippers 9', the cord clamps 25 close upon it and grip it, and simultaneously, or immediately afterward, the cord grippers 9' open to release the cord, thus completing its transfer to the carriage-carried cord clamps 25 of the hanking machine. Such transfer is effected without substantial change in the position or orientation of the cord C'.

The coiling position of each turntable 20 is such that its coiling posts 22 project in the direction opposite to the direction of motion of the top stretches of the chains 8. The motor 28 that rotatably drives the turntables in the coiling position is a stepping motor whereby that turntable is always caused to stop with its coiling posts 22 substantially contained in the above-mentioned vertical plane that also contains the turntable axis. Further, the turntable carrier 21 is so located that when the turntable in the coiling position is stopped, its coiling posts project across the line defined by a Cord C' at the discharge station of the lead forming machine and are spaced vertically to opposite sides of that line.

Therefore, when the turntable 20 in the coiling position begins to rotate, after the cord C' has been transferred to the cord clamp 25 of the feed mechanism 12, the coiling posts 22 of that turntable engage the cord C' after about one-quarter of a revolution; and with continued rotation the cord is wound up in a manner that draws its ends inwardly towards the turntable axis, as portrayed in FIG. 2. Meanwhile, the cord clamps 25 on the carriages 24 maintain their grips on the opposite end portions of the cord C', with the result that the coiling of the cord draws each carriage 24 inwardly along the rail 23, against the bias of its biasing device 26. Each carriage 24, in its cooperation with the rail 23, thus affords guidance to an end portion of the cord C', confining the cord against whipping and flailing but allowing the ends of the cord to move in towards the turntable at whatever rate the coiling operation demands. When inward motion of each carriage 24 brings it to its releasing position, in which the carriage is relatively close to the axis of the rotating turntable, the carriage engages a microswitch or similar sensor 29 that causes the cord clamp 25 on the carriage to be actuated to its open position. At about the same time the stepping motor 23 will stop the rotation of the turntable, inasmuch as the stepping motor 28 drives the turntable through a predetermined number of half-revolutions at each rotation, and the sensors 29 are located in accordance with cord length, distance between the coiling posts 22 and number of turntable revolutions in the coiling cycle.

As soon as the cord clamp 25 of a carriage 24 releases its grip on a cord, the carriage returns to its initial position under the force of its biasing device 26. It will be apparent that the release position of each turntable depends upon the location of its sensor 29, and the sensors are therefore preferably mounted on the rail 23 for adjustment along it. The cord clamp 25 on each carriage remains open as the carriage returns to its initial position and until a new cord is brought into the discharge station of the lead forming machine, whereupon the above described transfer and coiling operations are repeated. In their initial positions the carriages 24 are well clear of the turntables 20 as the turntable carrier 21 swings them between their coiling and their typing positions.

On each turntable 20 there are two pairs of coil holding claws 30 (FIG. 4, 11, 12), one pair adjacent to each of the coiling posts 22. Each pair of claws 30 maintains an open, widely diverged relationship until the coiling operation is completed. When the turntable stops rotating, each pair of coil holding claws 30 swings forward to converge around the coiled cord and prevent it from uncoiling or being displaced outwardly off of the posts 22. Thereupon the turntable carrier 21 swings around through 180°, exchanging the positions of the two turntables 20. The feeding and coil winding processes are repeated for the turntable now in the coiling position, and meanwhile the coiled cord is tied and removed from the other turntable.

Figure 11:
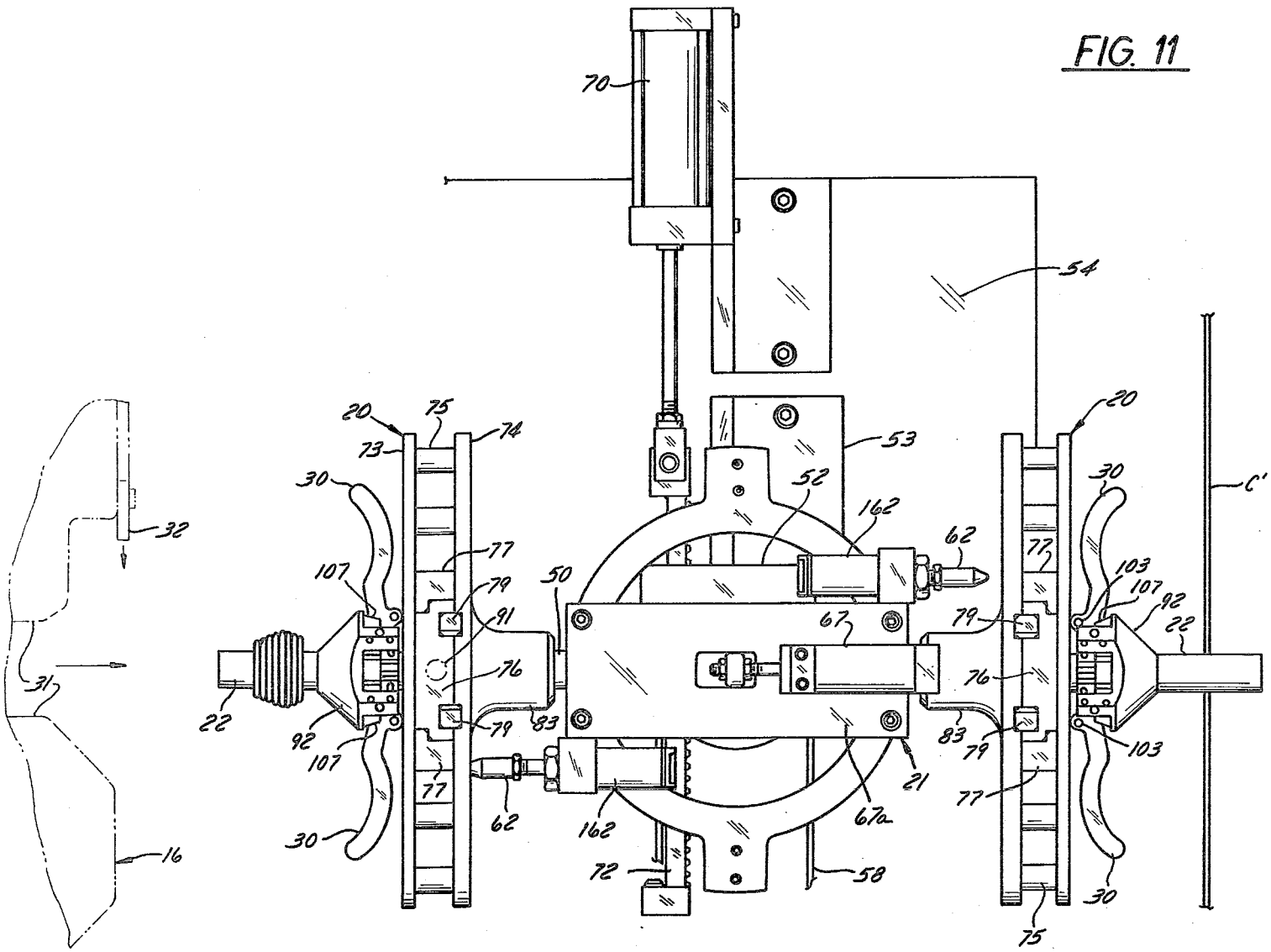
Figure 12:
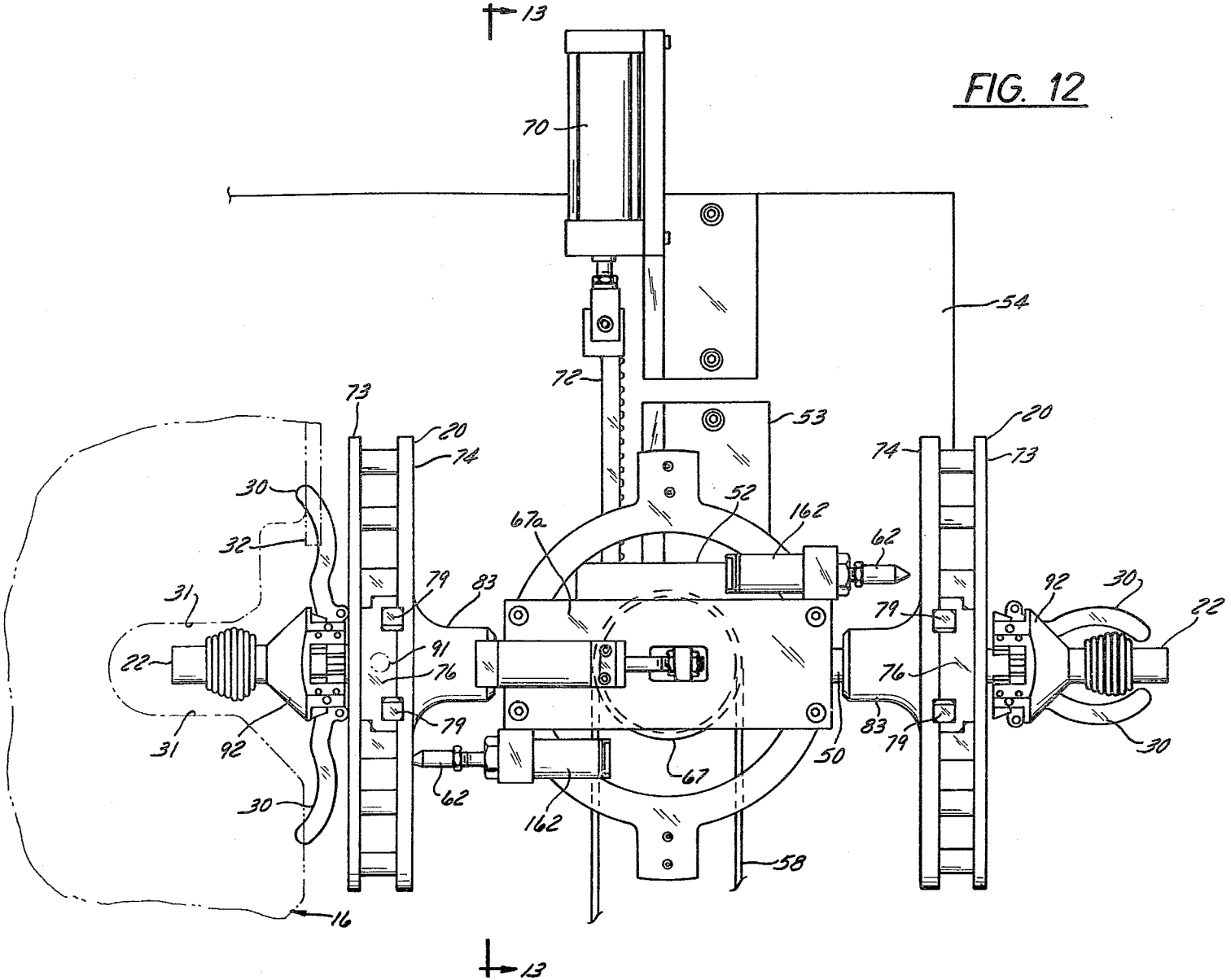
Figure 17:
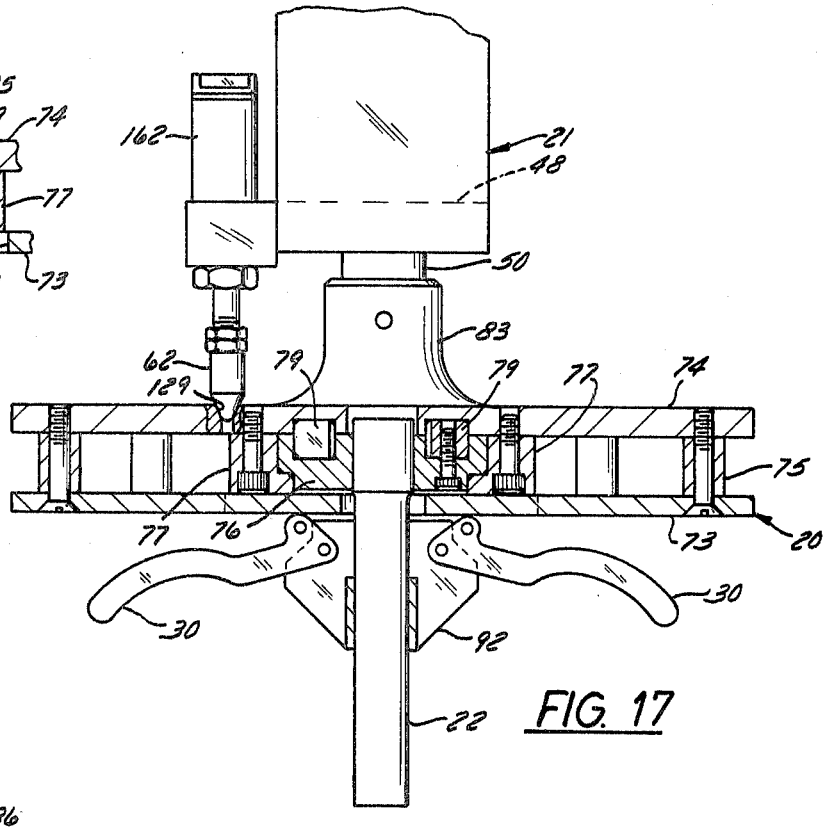

After a turntable 20 arrives at its tying position, but before actual tying takes place, its coil holding claws 30 are brought back to their diverged open condition (FIGS. 11 and 17) so that they will not interfere with the tying operation.

Figure 4:
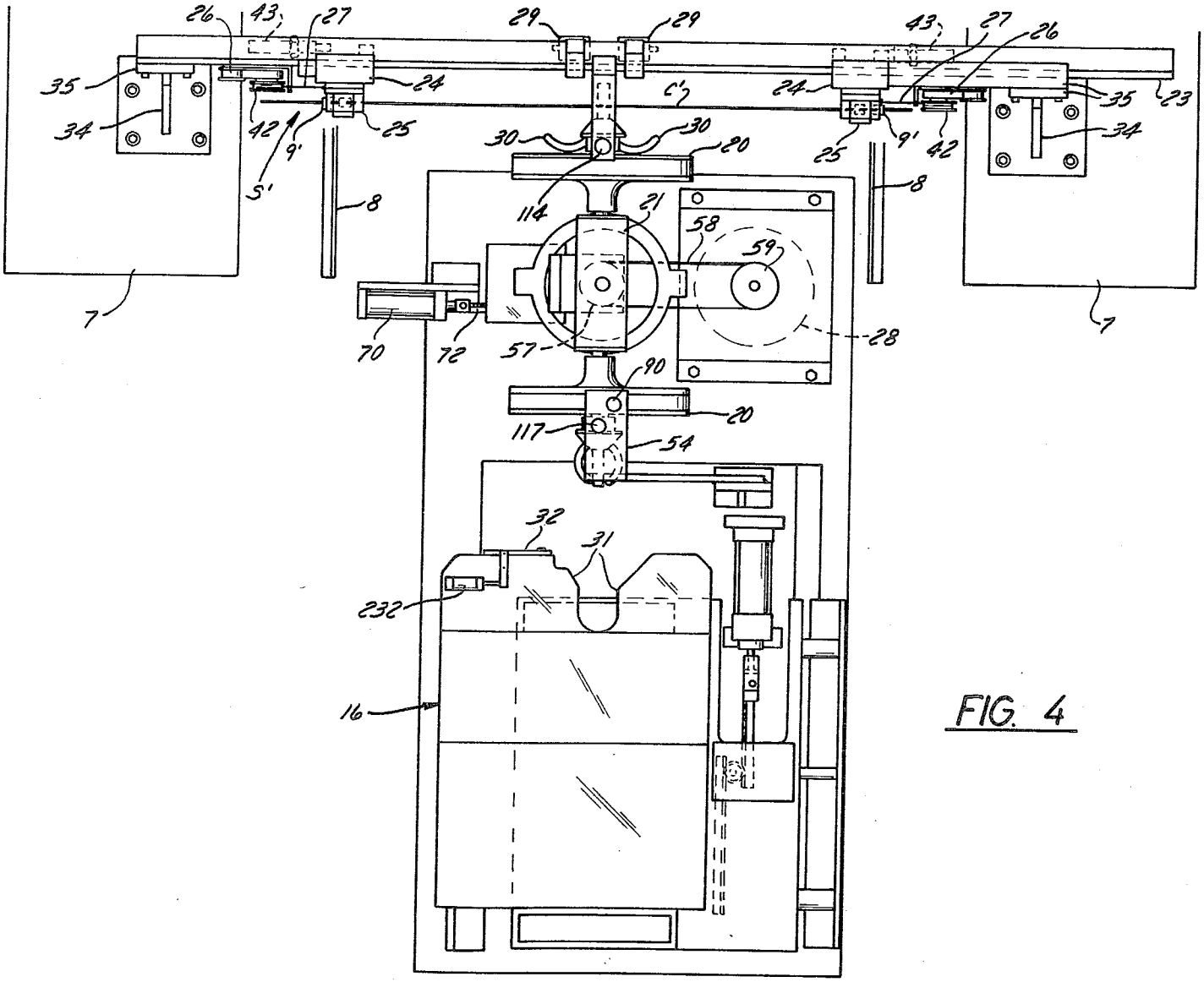
Figure 7:
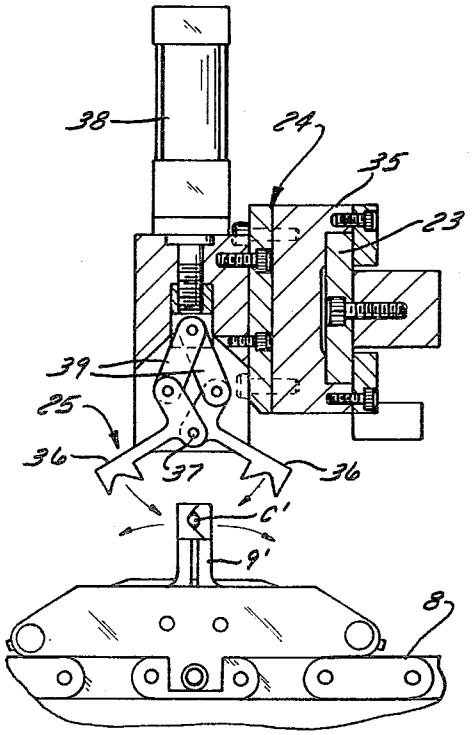
Figure 6:
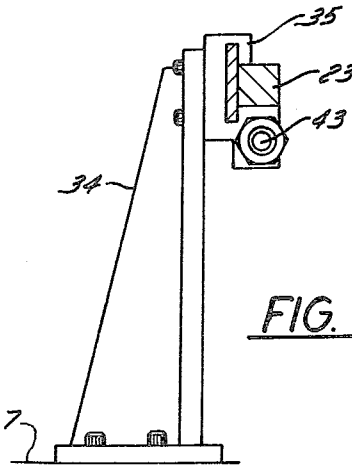
Figure 5:
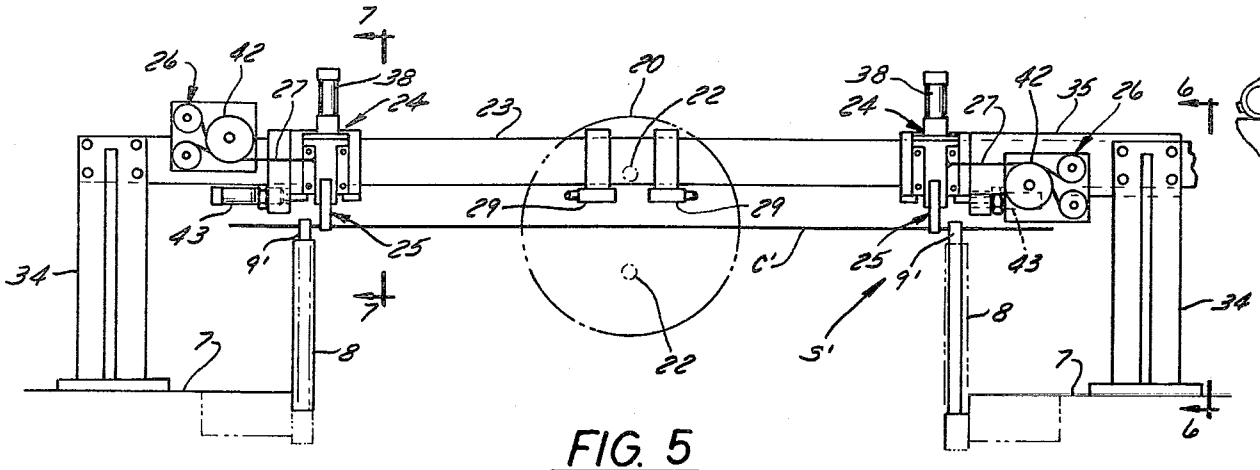

The tying machine 16 (FIGS. 1, 4 and 10–12) that applies the wire tie 18 is generally conventional, but it is mounted for bodily motion towards and from the turntable carrier 21. When a turntable 20 first comes into its tying position, the tying machine 16 is in a retracted position, substantially spaced from the turntable carrier 21, as shown in FIGS. 1 and 4. When the coil holding claws 30 have opened, the tying machine 16 moves bodily to an operating position (FIG. 24) in which its jaws 31 embrace the coiled cord on the turntable, midway between the coiling posts 22, and the machine 16 functions in its conventional manner to loop a wire tie 18 around the coil and twist the ends of the tie to secure it.

Figure 24:
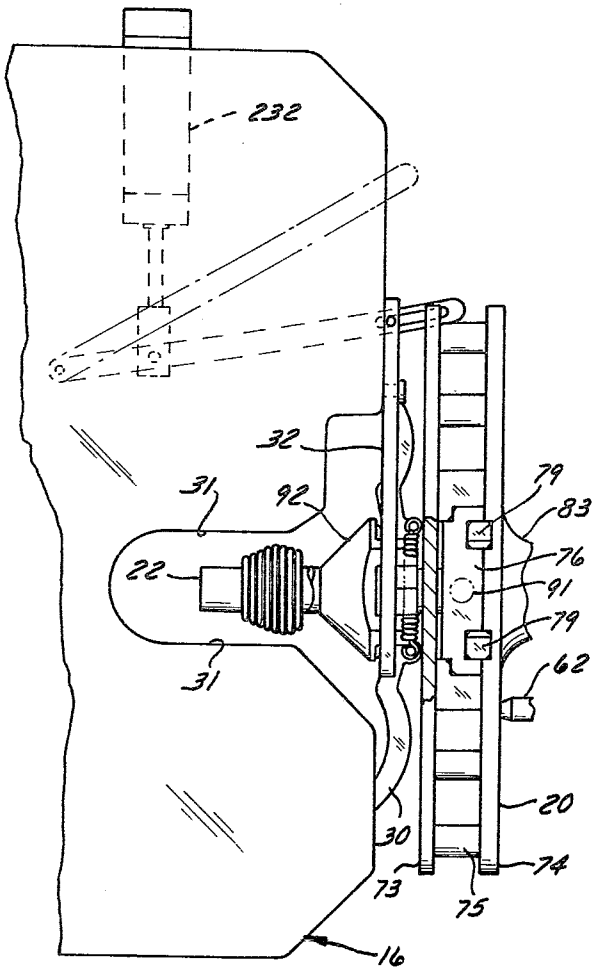

As the tying machine 16 moves to its operative position, the coiling posts 22 on the turntable in the tying position are moved toward one another to some extent, as explained hereinafter, to slacken the coil after tying but prior to retracting tying machine. The posts 22 are held in that converged relationship as the tying machine moves back to its retracted position, so that the tied coil can be readily slid endwise off of the posts. During the time that tying is taking place, a hank removal claw 32 (FIG. 24) on the tying machine 16 moves laterally to interpose itself between the coil and the face of the turntable. Hence, when the tying machine 16 moves back to its retracted position after the tie 18 is applied, the hank removal claw 32 pulls the hanked lead off of the posts 22 and drops the hank into a chute or the like (not shown). The hank removal claw 32 is actuated by a pneumatic cylinder actuator 232 that is carried by the tying machine 16, as best seen in FIG. 24.

Feed Mechanism

The rail 23 (FIGS. 1, 4–6, 8 and 9) on which the carriages 24 of the feed mechanism 12 are slidable is supported near each of its ends by a post or standard 34; and, in turn, each standard 34 is secured at its bottom to one of the frame members 7 of the lead forming machine, in laterally outwardly spaced relation to the top stretch of the chain 8 on that frame member. A clamping bracket 35 (FIG. 6) at the top of each standard 34 secures the rail 23 to the standard in such a manner as to permit lengthwise sliding adjustment of the rail relative to at least one of the standards when the frame members 7 are shifted towards or from one another during readjustment of the apparatus to accommodate a different cord length.

In this case the rail 23 is of generally T-shaped cross-section, with its stem portion projecting towards the infeed end of the lead forming machine. As can be seen from FIGS. 6 and 7, each of the carriages 24 has a transverse slot therethrough wherein the cross-bar portions of the rail 23 is received so that the carriage slidingly embraces the rail. The cord clamp 25 of each carriage 24 is located in a downwardly opening slot in the carriage (FIG. 7) and comprises opposing jaw members 36 that swing downwardly and towards one another about a mutual fulcrum pivot 37 that is secured in the carriage with its axis parallel to the directions of carriage travel. The jaw members 36 are actuated for their downward convergence and upward divergence by means of a pneumatic cylinder actuator 38 which is mounted on top of the carriage 24 with its piston rod projecting downwardly and connected with the jaw members by means of links 39. As shown, the actuator 38 is of the single-acting type, having its piston rod biased upwardly so that it tends to maintain the jaws 36 in their open condition. The pressure air connections to the respective actuators 38 are not shown because they obviously comprise flexible hoses extending from suitable valve means that can be mounted on the stationary structure.

The biasing devices 26 by which the carriages 24 are urged outwardly along the rail 23 are preferably mounted on the rail, each inwardly adjacent to one of the standards 34. Each biasing device 26 can be of a commercially available type comprising a drum 42 that is rotationally biased in a direction to wind up the cable 27 and whereby a tension force is maintained upon the cable that is substantially uniform in all positions of the carriage 24 along the rail. The biasing devices 26 are preferably shiftable along the rail 23 to accommodate adjustment towards and from one another of the frame members 7 of the lead forming machine.

Also mounted on the rail 23 for adjustment along it are a pair of shock absorbing bumpers 43, one for each carriage 24, each positioned to be engaged by its carriage and define the initial position thereof. Similar bumpers can be associated with the sensors 29 that define the release positions of the carriage inasmuch as the carriages are drawn inward at fairly high speed by the cooiling rotation of the turntable. Each release sensor 29—whether a microswitch or pneumatic valve—controls the supply of pressure air to its associated pneumatic actuator 38 in an arrangement that will be obvious. Since the cord clamps 25 on the carriages 24 should remain open until some time after the carriages have returned to their initial positions, closure is preferably effected under the control of programming apparatus indicated at 45 (comprising a computer or the like), and each outer bumper 43 can comprise a sensor that delivers a "ready" impulse to the programming apparatus to signify that the carriage is in a position to receive a new cord when one is presented by the cord grippers 9 of the lead forming machine. It will be apparent that the programming apparatus 45 coordinates closure of the cord clamps 25 with opening of the cord grippers 9 and with the start of turntable rotation, and it can therefore comprise a suitably modified form of the programming apparatus conventionally employed with lead forming machines.

Turntable Carrier and Rotation Drive for Turntables

Figure 14:
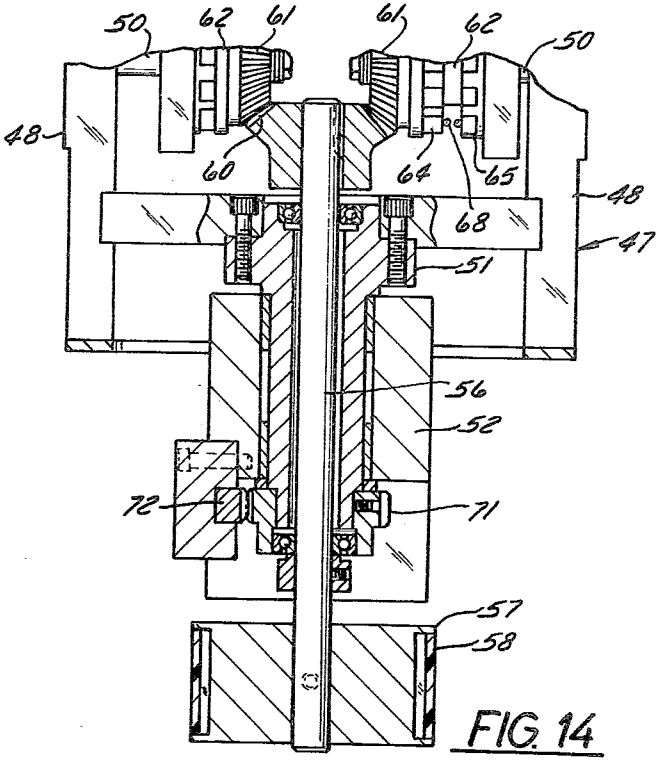
Figure 13:
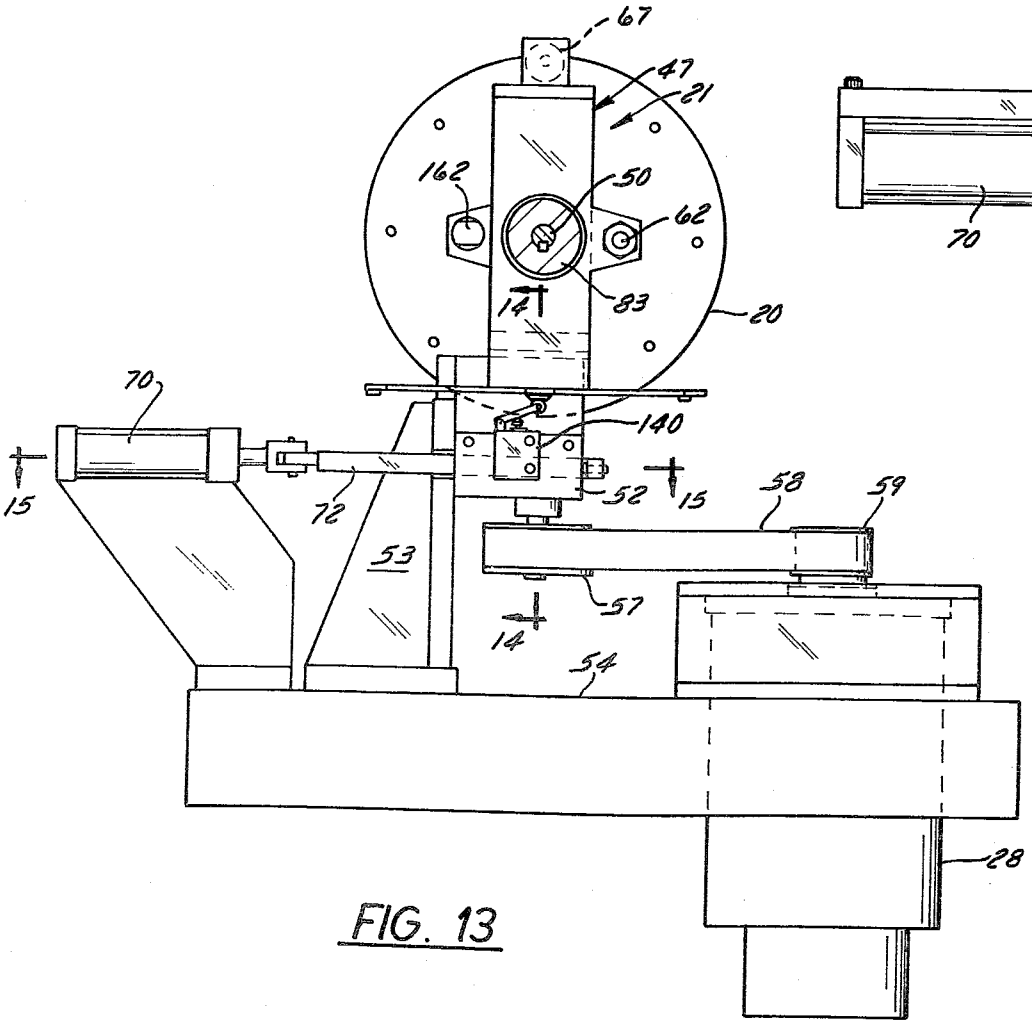

The turntable carrier 21 (FIGS. 10 and 14) comprises a U-shaped yoke 47 having upright legs 48, each of which supports a bearing 49 wherein a shaft 50 for one of the turntables 20 is rotatable. The bight portion of the yoke 47 is attached to the enlarged diameter top portion of an upright tubular shaft 51 and extends transversely to that shaft. The smaller diameter main portion of the tubular shaft 51 is received in a fixed bearing block 52, to define a vertical swinging axis for the yoke, and the bearing block 52 is, in turn, supported by an upright post 53 by which it is cantilevered in upwardly spaced relation to the top of a table-like fixed frame structure 54 of the hanking machine (FIG. 13).

Rotation is transmitted from the stepping motor 28 to the turntables 20 through a torque shaft 56 (FIG. 14) which rotatably extends through the tubular shaft 51 that supports the yoke 47. The lower end portion of the torque shaft 56 projects below the cantilevered bearing block 52, and fixed thereto is a driven pulley 57 which is connected by a belt 58 with a driver pulley 59 (FIGS. 4 and 13) on the shaft of the stepping motor 28. To constrain the torque shaft 56 to unison rotation with the stepping motor 26, so as to ensure that a driven turntable will always stop in its desired rotational orientation, the belt 58 is of the toothed positive-drive type, and the driver pulley 59 and the driven pulley 57—around which that belt is trained—are of like diameter and have teeth that mesh with those on the belt.

Fixed to the upper end of the torque shaft 56 is a driving bevel gear 60 which has constant meshing engagement with two driven bevel gears 61, one for each of the turntable shafts 50. Each driven bevel gear 61 is freely rotatable on the inner end of its turntable shaft 50 but is confined against axial motion relative to that shaft.

When the stepping motor 28 operates, it drives only the turntable 20 in the coiling position, and the other turntable is locked against rotation by a latching rod 62, as described hereinafter. To transmit rotation from the driving bevel gear 60 to the shaft 50 of the turntable in the coiling position, the driven bevel gear 61 on each shaft 50 is coupled to it by a clutch 62. When the stepping motor 28 is not operating, the clutch 62 is disengaged and both driven bevel gears 61 turn freely on their shafts 50, to prevent torque from being imposed upon the stepping motor 28 during swinging of the turntable carrier 21.

The clutch 62 just mentioned (FIGS. 10 and 14) comprises a clutch facing 64 on each driven bevel gear 61, on the axial surface of the bevel gear that faces its turntable, preferably comprising axially projecting circumferentially spaced teeth. On each turntable shaft 50, between its bevel gear 61 and the adjacent leg 48 of the U-shaped yoke, there is a collar-like driven clutch element 65 which has a clutch facing that mates with the one on its adjacent bevel gear 61. Each clutch element 65 has a splined connection with its turntable shaft 50 that allows it to slide axially to and from clutching engagement with its bevel gear 61 but constrains its shaft 50 to rotate with it. A U-shaped clutch shifting yoke 66 has opposite legs which embrace the two driven clutch elements 65 to shift them simultaneously in one direction or the other along the turntable shafts 50. A mounting strut **67*a* that extends across the legs 48 of the turntable carrier yoke 47 supports a double-acting pneumatic clutch actuator 67 whereby the shifting yoke 66 is shifted to each of its defined positions. Each clutch element 65 is biased away from its adjacent bevel gear 61 and into engagement with its adjacent leg of the shifting yoke 66 by means of a coiled compression spring 68 that surrounds the turntable shaft 50 and reacts between the clutch element 65 and its bevel gear 61**.

Figure 15:
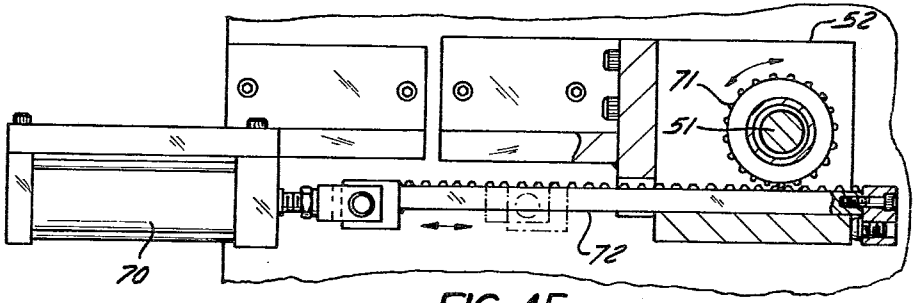

The 180° degree rotations of the turntable carrier 21 are imparted to it by means of a double-acting cylinder jack 70 (FIGS. 11, 12 and 15) that is mounted with its axis horizontal. Extension and retraction of the piston rod of that jack are translated into swinging motions of the turntable carrier 21 by means of a pinion 72 that is concentrically fixed on the tubular shaft 51 above the bearing 52, in cooperation with a rack 72 that extends legnthwise from the piston rod and meshes with the pinion 71. Other suitable devices for producing 180° rotations in opposite directions are available and may be preferable in practice, although the rack and pinion mechanism 70, 71, 72 that is here illustrated has been found satisfactory in a prototype machine.

Turntables

Figure 18:
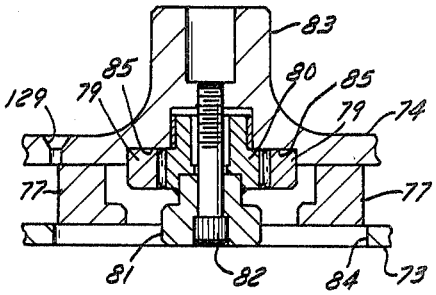

Each turntable 20 (FIGS. 16–18) comprises a front plate 73 and a back plate 74, both of which are disc-like and of like diameter, and which are secured in coaxial, spaced apart relationship by means of bolts that extend through spacer sleeves 75. The back plate 74 has a coaxial hub 83 on its rear by which it is anchored to the outer end of the shaft 50 for the turntable. Each of the coiling posts 22 of the turntable is mounted on a slider 76 that is between the two plates 73, 74 and is confined by L-section gibs or rails 77 to sliding motion in directions towards and from the turntable axis. To accommodate the motions of the posts 22 with their respective sliders 76, the front plate 73 has radially elongated slots 78 which extend in opposite radial directions from a large central hole 84 therein and through which the coiling posts 22 respectively project.

Figure 16:
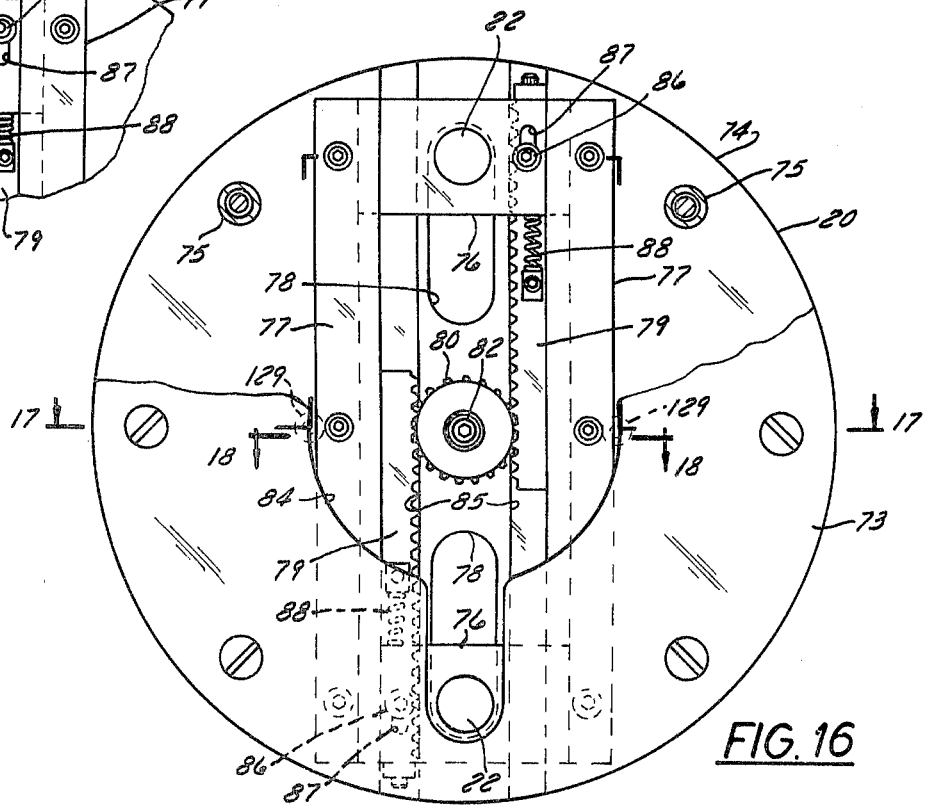
Figure 22:
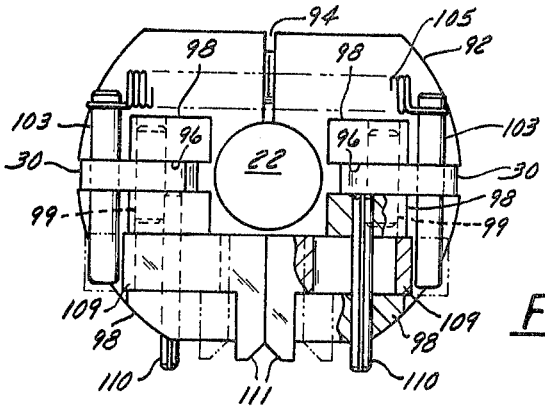
Figure 21:
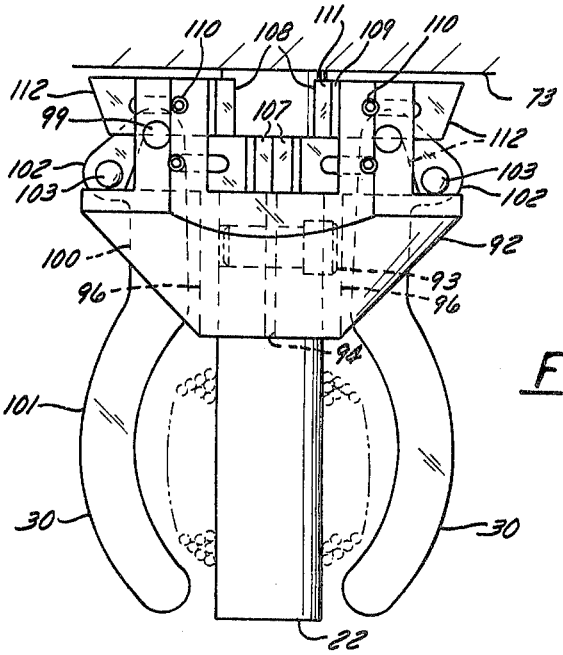
Figure 20:
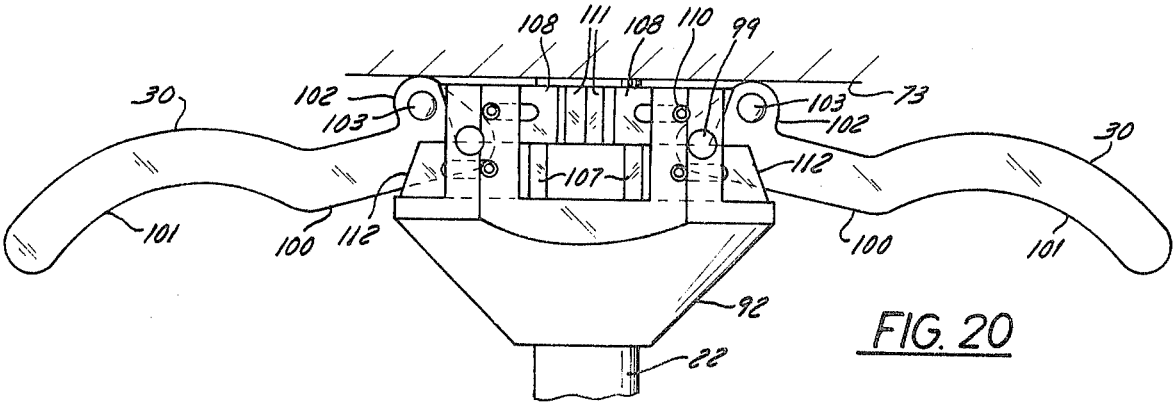
Figure 23:
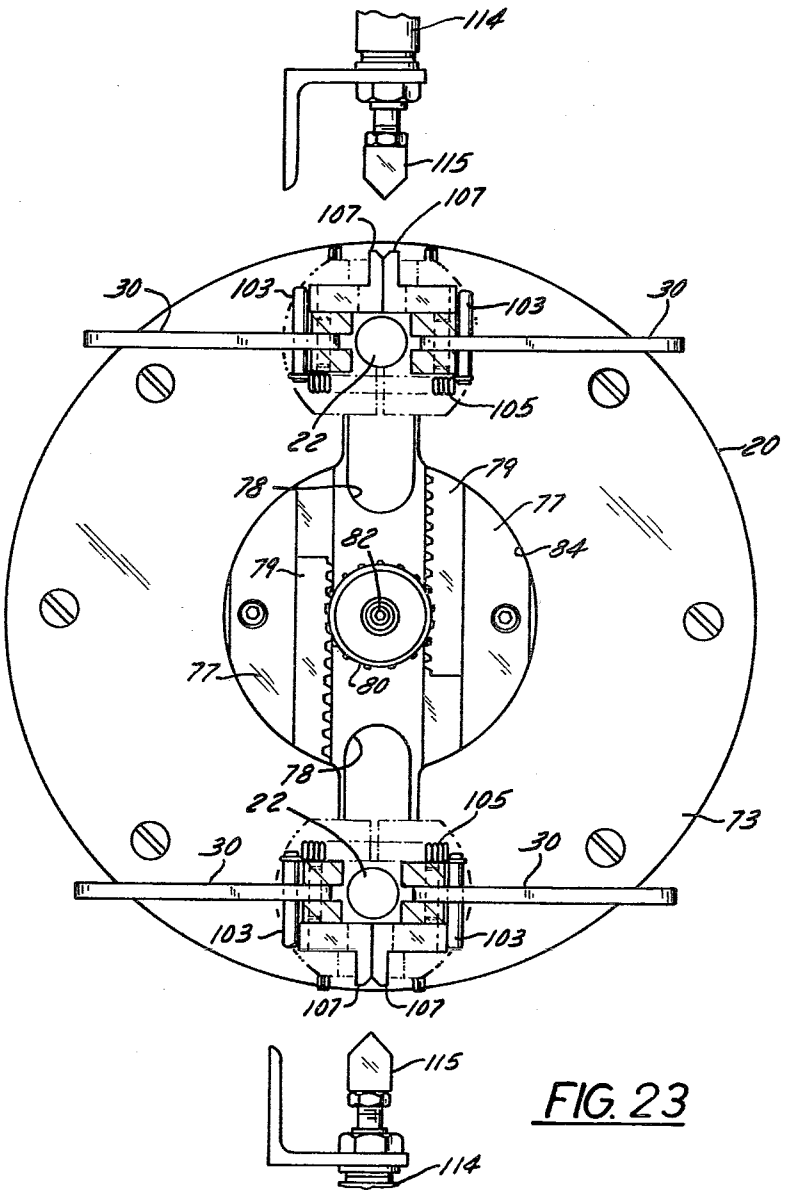

Adjusted positions of the sliders 76, and hence of their coiling posts 22, are established by a pair of slide racks 79, one for each slider 76, both of which cooperate with an adjusting pinion 80 that is coaxially mounted in the turntable. The respective racks 79 meshingly engage the pinion 80 at diametrically opposite sides thereof (as best seen in FIGS. 16 and 23), and they extend in opposite radially outward directions substantially parallel to the slots 78 in the front plate. At its front side the pinion 80 is formed as a coaxial knob 81 (FIG. 18) which is accessible through the central hole 84 in the front plate 73 and by which the pinion 80 can be adjustingly rotated manually. However, the pinion 80 is normally confined against rotation by means of a clamping screw 82 that extends coaxially rearwardly through it and is threaded into the hub 83 on the back plate. When the clamping screw 82 is loosened, rotation of the pinion 80 by means of its knob 81 shifts the two racks 79 simultaneously, both racks moving either radially inwardly or radially outwardly, always through equal distances. Through a connection (described hereinafter) between each rack 79 and its post-carrying slider 76, such adjustment of the racks effects simultaneous positioning of the two coiling posts 22.

The racks 79 are guided for their lengthwise motion in grooves 85 that extend across the front face of the back plate 74. Each rack 79 is further confined to lengthwise motion by its slider 76, which overlies the front face of the rack and which is itself confined to sliding motion by the L-section rails 77 that are secured to the front face of the back plate 74.

The connection between each post-carrying slider 76 and its rack 79 permits the slider to have limited motion relative to its rack in directions lengthwise of the rack. That connection comprises a screw 86 that is threaded into the rack and extends through a slot 87 in the slider that is elongated lengthwise of the rack. A coiled expansion spring 88 reacts between each slider 76 and its rack 79 to bias the slider in the direction away from the turntable axis, thus normally maintaining the slider 76 in its position in which the screw 86 is at the radially inner end of its slot 87.

Figure 19:
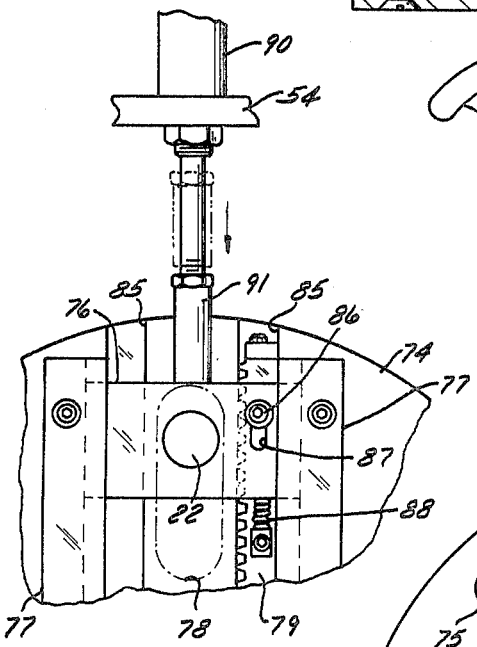

For converging the coiling posts 22 of the turntable 20 in the tying position, so that a hanked cord can be readily slid off of it by the hank removing claw 32 on the tying machine, there are (FIGS. 10 and 19) a pair of pneumatic actuators 90 on the fixed machine frame 54, one for each slider 76 of the turntable, each comprising a pneumatic cylinder that has its axis aligned with its slider 76 and oriented vertically, transversely to the turntable axis. The piston rods 91 of the actuators 90 extend simultaneously, engaging the respective sliders 76 to displace them towards the turntable axis, against the bias of the springs 88. The sliders 76 are released by the actuators 90 immediately after the hanked cord has been drawn off of the coiling posts 22 by return of the tying machine 16 to its retracted position.

The pair of coil holding claws 30 for each coiling post 22 serves to prevent a wound coil from sliding off of the posts when the turntable carrier 21 makes its 180° swing. Each set of claws 30 and the mechanism for actuating it (FIGS. 17 and 20–22) is carried by a split collar 92 which is clampingly secured to its coiling post 22, adjacent to the front plate 73 of the turntable, by means of a clamping screw 93 which extends across the split 94 in the collar. The front portion 95 of the collar 92 comprises a forwardly tapering frustoconical guide surface whereby turns of cord being wound around the post 22 are guided forwardly to form a compact coil. The claws 30 are received and guided in deep slots 96 in the collar 92 that open radially outwardly in opposite directions and extend all the way through it axially. As its rear the collar 92 has six rearwardly projecting post-like lugs 98 that are spaced from one another. There are two such lugs 98 at each side of each claw-guiding slot 96 in the collar, which lugs are bridged by a pivot pin 99; and on each such pivot pin one of the claws 30 is swingable.

Each claw 30 is a flat piece of metal having a straight rear end portion 100 which lies alongside its coiling post 22 when the claw is in its operative position and a front end portion 101 which is curved to embrace a coil of cord and which is therefore concave at its side facing the post. The pivot pin 99 extends through the claw near its rear end, the axis of that pin being transverse to the flat surfaces of the claw. On the straight rear portion 100 of the claw, projecting laterally outwardly therefrom, is a lug 102 through which a toggle pin 103 extends with its axis parallel to that of the pivot pin 99. Considering the claw in its forwardly projecting operative position, the toggle pin 103 is spaced both forwardly and radially outwardly from the pivot pin 99; hence as the claw is swung between its open and its operative positions, the toggle pin 103 swings through an arc that carries it away from the adjacent post 22 and then back towards it again. Connected between the toggle pins 103 on the two claws 30 for each post 22, at one side of the post, is a tension spring 105 that serves to draw those claws to their operative and to their open position with a toggling snap action.

Slidably confined between the flat front face of the turntable front plate 73 and the flat rear face of the collar 92 are two pairs of cam blocks, namely a front pair 107 which serves to actuate the claws 30 to their open or diverged positions and a rear pair 108 for actuating the claws to their operative positions. Each of the cam blocks 107, 108 is substantially L-shaped, with a D. biasing means yieldingly urging each carriage to its initial position;

E. release means for each carriage arranged to effect opening of the chord clamp of the carriage when the carriage arrives at its release position; and F. sequencing means for closing the cord clamps of the carriages when the carriages are in their initial positions and thereafter initiating rotation of the turntable.

2. The hanking machine of claim 1 wherein said turntable orienting means comprises a turntable carrier upon which said turntable is rotatably mounted and which pivots about an axis transverse to said turntable axis to carry the turntable bodily between said coiling position and a tying position, further characterized by:

G. a tying machine for applying a wire tie around a coiled cord on the coiling posts; and H. means for moving said tying machine in opposite directions towards and from the turntable when the turntable is in its tying position.

3. The hanking machine of claim 1 wherein said turntable orienting means comprises a turntable carrier upon which said turntable is mounted for rotation with its turntable axis horizontal and which swings about a vertical pivot axis that substantially intersects said turntable axis.

4. A hanking machine for cooperation with a lead forming machine that comprises a pair of endless chains having horizontal and parallel laterally spaced top stretches that move intermittently in one direction, and cord grippers on each chain, at lengthwise spaced intervals therealong, so arranged that a cord gripper on each chain grips each of a succession of cords near its opposite ends to hold it horizontally extended and carry it in said direction, transversely to its length, to a discharge station at which the cord extends substantially along a predetermined line and at which the cord grippers release the cord, said hanking machine being characterized by:

A. a pair of carriages, each comprising a cord clamp that can be closed to grip a cord and opened to release the cord;

B. guide means confining said carriages to horizontal convergent and divergent movement with their cord clamps tracking said line, between diverged initial positions of the carriages wherein they are respectively near said stretches and release positions near to, but at opposites sides of, vertical plane intermediate and parallel to said stretches;

C. biasing means yieldingly urging each carriage to its initial position;

D. a turntable having a rotational axis and having a pair of coiling posts projecting from one axial side thereof that are substantially parallel to said axis and spaced to opposite sides thereof;

E. a turntable carrier for supporting said turntable in a coiling position wherein its coiling posts project oppositely to said one direction and across said line and its said axis is substantially contained in said plane and is near said line;

F. drive means for rotating said turntable in its coiling position and for establishing it in a rotational orientation wherein its coiling posts are spaced vertically to opposite sides of said line;

G. sequencing means arranged to close the cord clamps of the carriages substantially simultaneously with release of a cord at the discharge station by the cord grippers and to initiate rotation of the turntable upon closure of the cord clamps; and H. release means for each carriage, arranged to open the cord clamp of the carriage when the carriage reaches its release position.

5. The hanking machine of claim 4, further characterized by:

I. said turntable carrier being mounted for rotation about a carrier axis transverse to said rotational axis, to carry the turntable between said coiling position and a tying position;

J. a tying machine for applying a wire tie around a coiled cord on the winding posts; and K. means for moving the tying machine bodily in opposite directions towards and from said turntable when it is in said coiling position.

6. The hanking machine of claim 5, further characterized by:

L. a pair of coil holding claws for each of said coiling posts, each pair having its claws mounted at opposite sides of its post for swinging motion between forwardly projecting converged positions and laterally projecting diverged positions, each of said claws being curved along its length to embrace a coiled cord and confine it against sliding forwardly along its post when the claws are in their converged positions;

M. toggle means for each of said pairs of claws comprising (1) spring means connected with the claws to yieldingly maintain them in each of their said positions, (2) first cam means slidable transversely to the post for the claws, for actuating the claws to their converged positions, and (3) second cam means slidable transversely to said post for actuating the claws to their diverged positions; and N. two pairs of actuators on fixed portions of the machine, (1) the actuators of one of said pairs thereof being cooperable with said first cam means to shift the claws to their converged positions upon conclusion of turntable rotation and while the turntable is in its coiling position, and (2) the actuators of the other of said pairs thereof being cooperable with said second cam means to shift the claws to their diverged positions when the turntable arrives at its tying position.

7. A hanking machine for cooperation with a lead forming machine having a pair of endless chains arranged on elongated substantially stationary frame members to have horizontal top stretches which are parallel to one another and along which cord grippers, at lengthwise spaced intervals on each chain, move intermittently in one direction, said cord grippers being so arranged that a pair of them, one on each chain, grip each of a succession of cords near opposite ends thereof and carry it to a discharge station at which the cord extends substantially along a predetermined horizontal line transverse to said stretches and at which they release it, said hanking machine being characterized by:

A. a pair of carriages, each comprising a cord clamp that is actuatable to a closed cord-gripping condition and to an open cord-releasing condition;

B. guide means confining said carriages to movement wherein their cord clamps track substantially along said line and whereby they are carried between base portion 109 which is guidingly confined between a pair of the rearwardly projecting post-like lugs 98 on the split collar 92 and is further confined by a pin 110 which is received in those lugs and extends through an elongated slot in the base portion of the cam block. Projecting laterally from the base portion 109 of each cam block 107, 108 is a cam portion which has an oblique cam surface 111 at its extremity. These cam surfaces 111 on each pair of cam blocks 107, 108 are inwardlyly convergent so that the two cam blocks can be wedged apart by an actuator inserted between them. The base portion 109 of each cam block has at its outer end a toggling cam surface 112 that cooperates with an adjacent toggle pin 103 to swing the claw in one direction when the cam blocks 107 or 108 are wedged apart.

Figure 10:
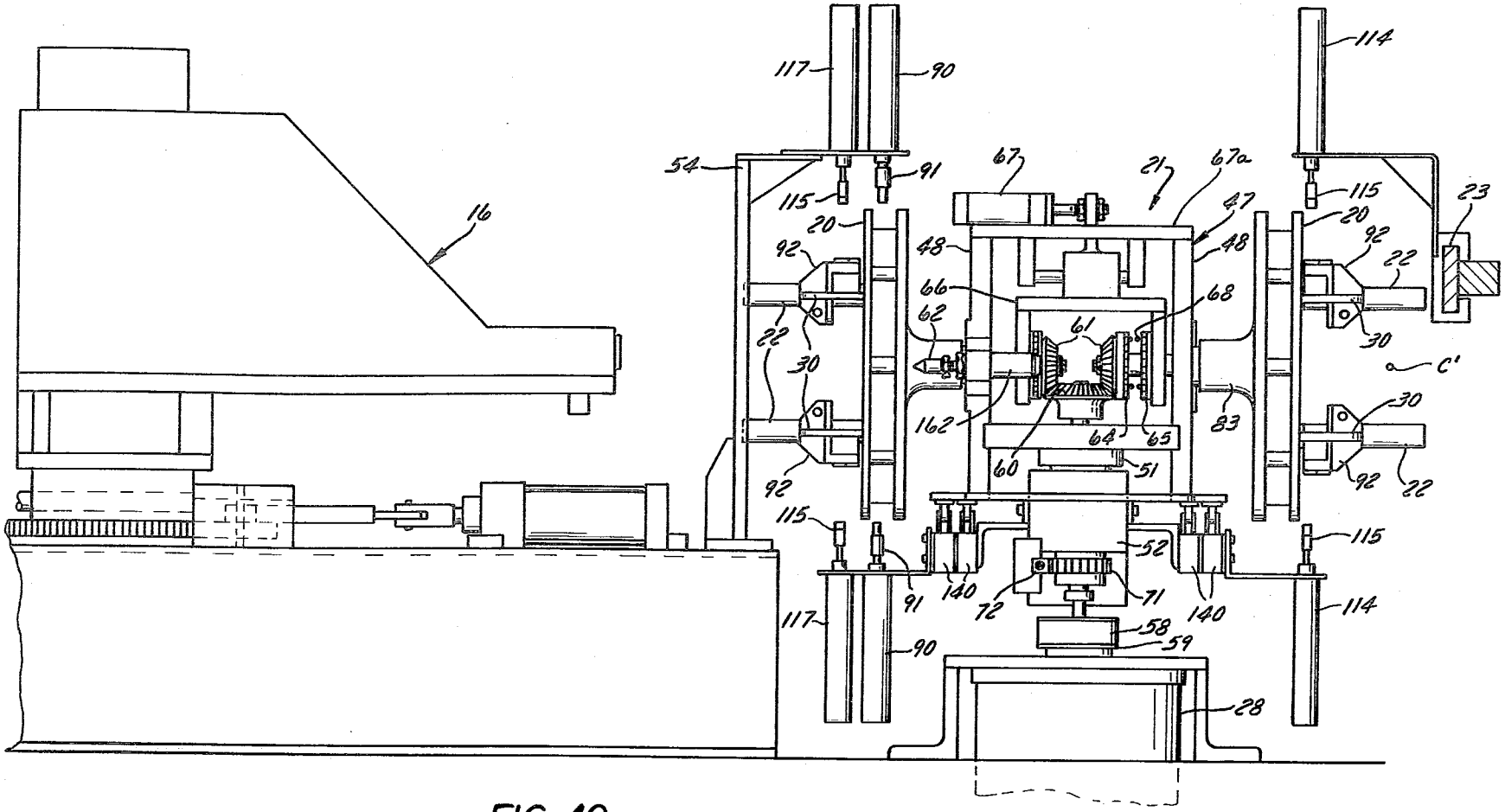

The claws 30 are swung forward to their operative position (FIG. 21) from their open or diverged (FIG. 20) condition by means of an actuator 114 which can comprise a pneumatic cylinder jack mounted on the fixed frame of the machine, alongside the turntable in the coiling position (FIGS. 10 and 23). The piston rod of that actuator 114, which moves in the direction towards the turntable axis, has its tip formed as a wedge 115 that comes between the cam surfaces 111 of the rear pair of cam blocks 108 and wedges them apart. Such divergence of the two rear cam blocks 108 is transferred to the toggle pins 103 on the respective claws through the toggling cam surfaces 112 on those blocks 108. For the turntable in the tying position there is an actuator 117 that is generally similar to the actuator 114, but it is arranged to wedgingly diverge the front pair of cam blocks 107 and thus cause the toggle pins 103 to be swung rearwardly and apart, toggling the claws 30 to their open condition. The toggling cam surfaces 112 on the several cam blocks 107, 108 are so formed that the toggle pins 103 can impart convergent movement to a diverged set of cam blocks 107, 108; and thus movement of the claws 30 to their operative condition converges the front pair of cam blocks 107 and movement of the claws to their open condition converges the rear pair of cam blocks 108.

For proper cooperation with both the feed mechanism 12 and the tying machine 16, each turntable 20, when not rotating, should be rotationally oriented with its coiling posts 22 vertically aligned. To lock each turntable in that orientation at all times that it is not being rotatably driven, each turntable has a rearwardly opening socket or well 129 in its back plate 74 (FIG. 17), and for each turntable there is a latching rod 62 on the turntable carrier 21 that is axially projected into the socket or well 129 to confine the turntable against rotation. The latching rod 62 can comprise the piston of a small pneumatic cylinder actuator or the plunger of a solenoid actuator. In any case, the actuator 162 for each latching rod 62 is mounted on the turntable carrier 21 behind its turntable, in radially spaced relation to the coinciding axes of the turntables and with the axis of its rod 62 parallel to the turntable axes. Each latching rod is projected to its latching condition, engaged in its well 129, immediately at the conclusion of coiling rotation of its turntable and while the turntable is still clutched to the stepping motor 28, and it remains in this latching condition through the time that the turntable is in its tying position and until it has returned to the coiling position and a new coiling rotation is about to start.

Timing

The several events in the sequence of operations performed by the machine can be timed in relation to one another in any suitable manner. Preferably, however, limit switches and timing cams are employed to a substantial extent, to ensure that one operation is successfully performed before the next operation is started. In most cases a limit switch will be actuated by an actuator when it attains one of its limit positions, but the turntable carrier 21 can also have one or more cams whereby limit switches (as indicated at 140 in FIG. 10) are actuated when that carrier reaches each of its defined positions. The locations, arrangement and manner of operation of all such switches will be evident from the preceding description, and therefore, to simplify the drawings, they have not been shown.

It is preferred that limit switches be connected as position sensors which provide inputs to the computer or other programming apparatus 45 that maintains overall control of the operating program in a known manner.

Experience has shown that the cord hanking machine of this invention can, in principle, operate in step with a conventional lead forming machine, but that the operating speeds of both the hanking machine and the lead forming machine with which it cooperates must be slowed to a little less than their potential rates to keep them in step with a conventional tying machine.

From the foregoing description taken with the accompanying drawings it will be apparent that this invention provides an automatic cord hanking machine which can receive cords one-by-one as they are delivered to it by a leading forming machine, coil each cord, tie it with a wire tie, and discharge the hanked cord to a delivery chute or the like, all without the intervention of a human operator. It will also be apparent that the cord hanking machine of this invention is arranged to cooperate directly with a conventional lead forming machine without requiring substantial modification thereof.

What I claim is:

1. A hanking machine whereby a cord can be wound into a coil around which a wire tie can be applied to form the cord into a hank, said hanking machine being of the type comprising a turntable rotatable about a turntable axis and having a pair of coiling posts projecting from it in one axial direction that are substantially parallel to said axis and are spaced to opposite sides thereof, and drive means for rotating said turntable, said hanking machine being characterized by:

A. turntable orienting means for establishing said turntable in a coiling position wherein its rotational axis and its coiling posts are substantially contained in a fixed vertical plane;

B. a pair of carriages, each having a cord clamp that can be closed to grip a cord and opened to release the cord;

C. guide means defining a path normal to said plane and confining said carriages to movement along said path, one at each side of said plane, between an initial position of each carriage in which it is spaced a substantial distance from said plane and a release position nearer said plane, said path being so located that a cord gripped by the cord clamps of the carriages is between the coiling posts when said turntable is in its said coiling position;

release positions in which they are near to, but at opposite sides of, a vertical plane intermediate and parallel to said stretches and initial positions in which they are respectively near said stretches and their cord clamps can grip opposite ends of a cord released by a pair of cord grippers;

C. biasing means yieldingly urging each carriage to its initial position;

D. a turntable rotatable about an axis and having a pair of coiling posts projecting from one axial side thereof that are substantially parallel to said axis and spaced to opposite sides thereof;

E. A turntable carriage rotatably supporting said turntable and whereby the turntable can be established in a coiling position with its axis in said plane and substantially intersecting said line and with its coiling posts projecting oppositely to said one direction and across said line;

F. drive means for rotating said turntable in its coiling position and for establishing it in a rotational orientation in which its coiling posts are spaced vertically to opposite sides of said line; and G. release means for each carriage arranged to effect opening of the cord clamp of the carriage when the carriage arrives at its release position.

8. The hanking machine of claim 7, further characterized by:

H. sequencing means arranged to close the cord clamps of the carriages substantially simultaneously with release of a cord by a pair of cord grippers at the discharge station and to initiate rotation of the turntable after closure of the cord clamps.

9. The hanking machine of claim 7, further characterized by:

said guide means comprising (1) a rail along which the carriages are slidable, and (2) a pair of standards by which opposite end portions of said rail are supported, each secured to one of said stationary frame members and projecting upwardly therefrom laterally adjacent to the chain stretch thereon.

10. The hanking machine of claim 9 wherein said release means for each carriage comprises a sensor mounted on said rail, near said plane, and which is engaged by the carriage as the carriage arrives at its release position.

11. The hanking machine of claim 9, further characterized by:

(1) said biasing means for each carriage comprising a biasing device which is fixed on said rail near one of said standards and which comprises a drum which is biased for rotation in one direction and around which a cable is wound that is connected with the carriage; and (2) a shock absorbing bumper for each carriage, mounted on said rail inwardly adjacent to the biasing device for the carriage to be engaged by the carriage when the latter arrives at its initial position.

* * * * *

United States Patent [19]

McGill

[11] 4,406,110

[45] Sep. 27, 1983

[54] POWER CYLINDER HAVING EXTERNAL STROKE ADJUSTMENT MECHANISM

[75] Inventor: Robert W. McGill, Munroe Falls, Ohio

[73] Assignee: A-T-O Inc. (now Figgie International), Ohio

[21] Appl. No.: 189,707

[22] Filed: Oct. 1, 1980

[51] Int. Cl.[3] ..... F15B 15/22; B65B 5/6; B65B 21/14

[52] U.S. Cl. ..... 53/249; 91/405; 91/444

[58] Field of Search ..... 91/404, 405, 406, 407; 53/249

[56] References Cited

U.S. PATENT DOCUMENTS

| | | | |
|---|---|---|---|
| 2,114,334 | 4/1938 | Conklin | 91/406 |
| 2,606,414 | 8/1952 | Dyrr | 91/404 |
| 2,606,532 | 8/1952 | Ziskol | 91/404 |
| 2,939,427 | 6/1960 | Peros | 91/404 |
| 3,015,309 | 1/1962 | Austin | 91/407 |

*Primary Examiner*—Paul E. Maslousky

*Attorney, Agent, or Firm*—Oldham, Oldham, Hudak, Weber & Sand Co.

[57] ABSTRACT

The stroke of an air driven power cylinder is controlled through a load means attached to the piston rod, a control valve means connected to the cylinder to control air exhaust from the cylinder on the extension stroke of the piston, and an external cushion valve means operably connects to the control valve means and the load means for air exhaust flow therethrough in a controlled manner but for shut-off of the air exhaust as the piston approaches the end of its stroke to trap some air in the cylinder before the piston stroke ends, the cushion valve means having a member therein of adjustable position for control of the length of stroke of the piston.

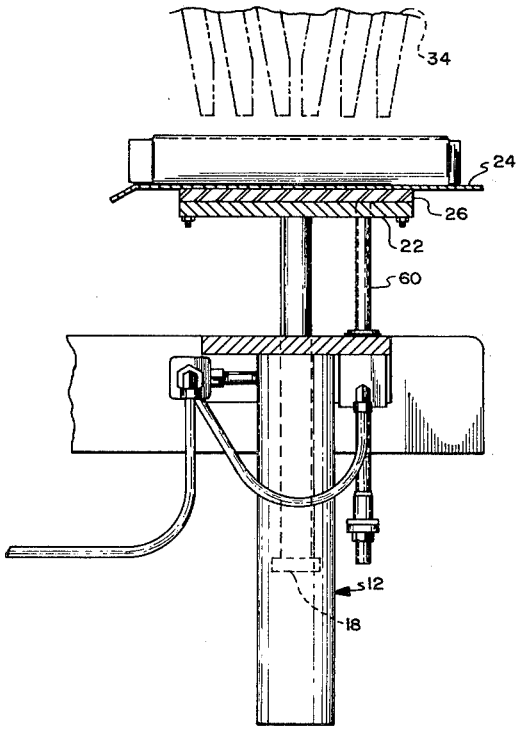

6 Claims, 7 Drawing Figures